US005292130A

United States Patent [19]

Hooper

[11] Patent Number: 5,292,130

[45] Date of Patent: Mar. 8, 1994

[54] GOLF DRIVING MAT

[76] Inventor: Michael Hooper, 624D Beaver Dam Road N.E., Calgary, Alberta, Canada, T2K 4W6

[21] Appl. No.: 851,969

[22] Filed: Mar. 16, 1992

[51] Int. Cl.[5] ..... A63B 69/36

[52] U.S. Cl. ..... 273/195 A; 15/216

[58] Field of Search ..... 273/176 J, 195 A, 195 R, 273/187.1; 15/215, 161, 162

[56] References Cited

U.S. PATENT DOCUMENTS

| | | | |
|---|---|---|---|
| 2,680,698 | 6/1954 | Schnee | 15/215 X |
| 3,459,107 | 8/1969 | Anderson et al. | 273/195 A |
| 3,735,988 | 5/1973 | Palmer et al. | 273/176 J X |
| 4,964,187 | 10/1990 | Dell Orto | 15/161 |
| 5,054,253 | 10/1991 | Bedics | 15/215 X |
| 5,190,799 | 3/1993 | Ellingson | 15/215 X |

FOREIGN PATENT DOCUMENTS

| | | | |
|---|---|---|---|
| 255352 | 9/1962 | Australia | 273/176 J |

*Primary Examiner*—George J. Marlo
*Attorney, Agent, or Firm*—George H. Dunsmuir

[57] ABSTRACT

The invention relates to a golf driving mat comprising a plurality of framed panel members assembled in edge-to-edge abutting relationship, the panel members and inner perimeter of the surrounding frame having releasable engagement means formed on the edges thereof for interlocking engagement of adjacent panel members and the inner perimeter of the frame, thereby permitting removal and replacement of panel members demonstrating wear.

4 Claims, 1 Drawing Sheet

GOLF DRIVING MAT

BACKGROUND OF THE INVENTION

This invention relates to a golf driving mat and, more particularly, to a mat simulating turf, in which the mat comprises a plurality of interlocking panels.

Golf driving ranges, which provide facilities for practice driving, normally are equipped with simulated grass mats at each driving station, in which upstanding bristles, embedded in a backing, provide a surface similar to the turf normally encountered on fairways and tee stations at golf courses.

Tee-off conditions are duplicated by the incorporation of an upstanding flexible tube or 'tee' extending above the surface of the simulated turf, upon which the practice ball may be positioned for driving. The tee is normally comprised of a flanged flexible tubular element, inserted upwardly through an aperture formed in the backing of the mat.

Dimensionally, the mat is usually rectangular in shape, perhaps six feet to the side, in order to freely accommodate the user while assuming a practice position standing on the mat addressing the ball so positioned on the tee.

As can be expected, the impact of the club head on the bristles of the mat ultimately results in the wearing or breakdown of the mat in the vicinity of the club head striking zone, which has heretofore necessitated the replacement of the golf practice mat, with attendant cost.

In partial response to the wear problem, a golf practice mat is depicted in U.S. Pat. No. 3,467,391 to Elesh, in which groups of bristles or tufts are replaceably mounted on the backing by means of anchoring rods, thereby providing for replacement of the tufts when necessary.

The structure of this invention addresses the wear problem in a novel fashion, by providing a mat comprised of interlocking panels which are readily assembled and allow for mat upgrading by simple removal of the panel exhibiting unacceptable wear, and its substitution with a replacement panel.

In its preferred embodiment, the panels are formed of molded plastic or an elastomeric substance such as hard rubber, with interlocking finger elements formed on the rectangular edges thereof, adapted for engagement with adjacent panels.

Another embodiment includes a perimeter frame into which the interlocking panels can be assembled, thereby to ensure a firm surface on which the golfer positions himself while driving.

SUMMARY OF THE INVENTION

Accordingly, it is a principle object of the invention to provide a golf practice mat comprised of panel members each adapted for replacement following unacceptable wear thereof.

It is a further object of the invention to provide a golf practice mat comprising panel members having interlocking edge elements.

It is a still further object of the invention to provide a golf practice mat comprising panel members assembled in a frame defining a continuous, outer perimeter adapted to securely retain the panel members in the desired configuration.

It is a further object of the invention to provide an apparatus of the type described which is characterized by a simplicity of design and possesses the necessary ruggedness for durable and reliable use.

Additional objects and advantages will become apparent from the following description taken in conjunction with the

Figure 1:
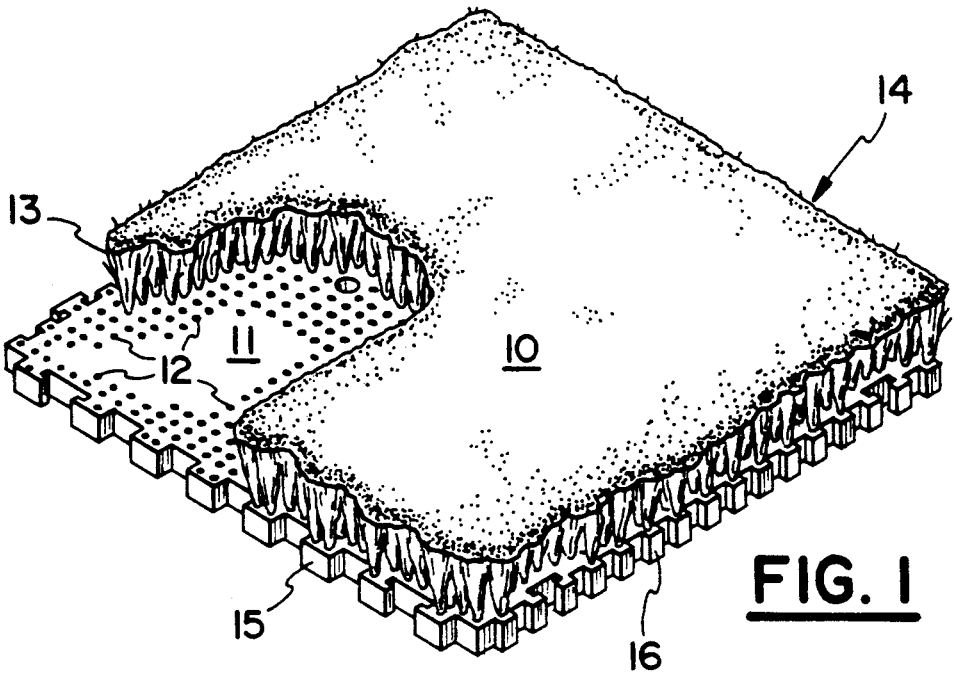
FIG. 1 is a perspective view of a panel member depicting the backing plate, upstanding tufts comprising the simulated turf, and edge interlocking means.

Referring to the drawings with initial reference to FIG. 1, the panel member 10, is depicted comprising a backing plate 11, of unitary molded material, such as hard rubber or plastic, of desirably square configuration. Regularly spaced rows of holes 12, formed in the upper surface of the backing plate 11, receive the lower ends of a plurality of groups or tufts of bristles 13, anchored therein for example, by adhesive retention, in order to form a mat surface 14. It will be appreciated that there are many ways to anchor bristles 13 in hole 12, the indicated use of adhesive is purely exemplary.

DESCRIPTION OF THE PREFERRED EMBODIMENTS

In the preferred embodiment depicted, a plurality of grooves and fingers 15 and 16, FIG. 1, are formed on the edges of the panel members 10, adapted to engage in interlocking fashion with registering fingers and grooves formed in adjacent panel members, thereby to rigidly lock the panel members into a secure mat of desired dimensions. A surrounding frame 17, FIG. 2, dimensionally appropriate to the desired mat size, engages the edges of the mat formed by the assembled panel members by engagement of outstanding finger members 15, with the registering grooves formed on the perimeter edge of the mat, thereby retaining the frame and panel members in solid unitary fashion, as depicted.

Figure 2:
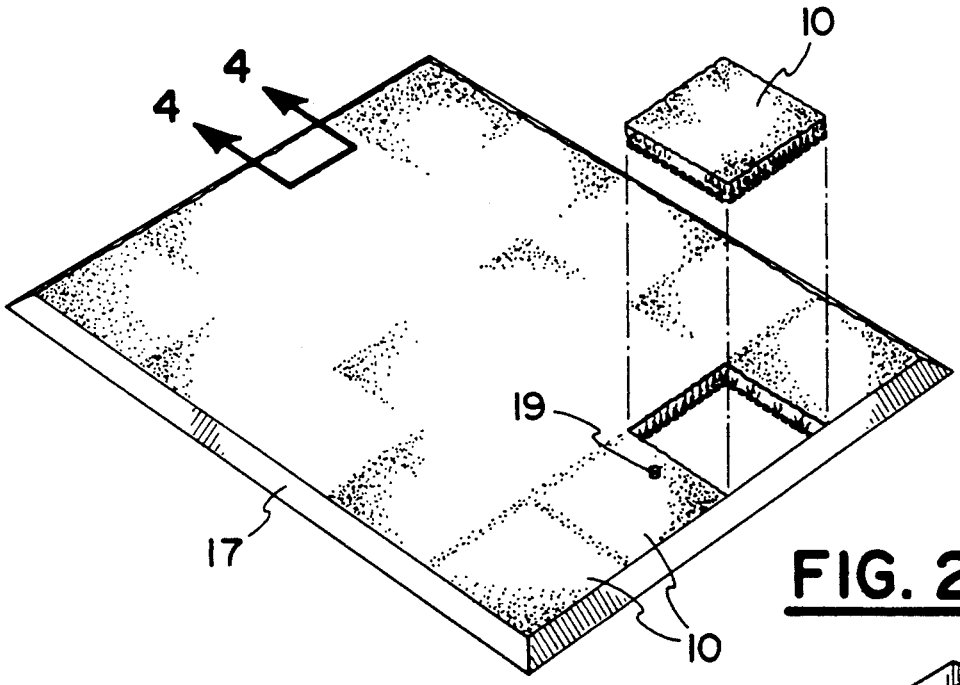
FIG. 2 is a perspective view of the assembled mat, depicting the panels secured within the perimeter frame.
Figure 3:
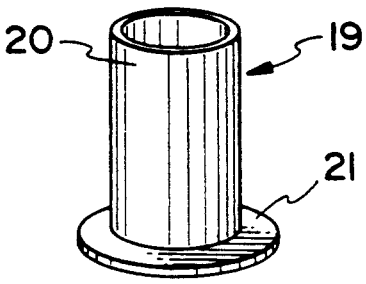
FIG. 3 is a perspective view of a typical tee suitable for use with the mat of the subject invention.
Figure 4:
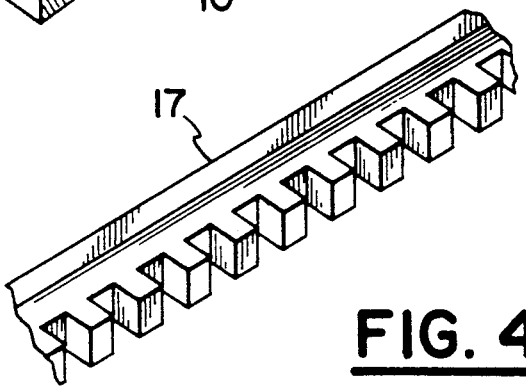
FIG. 4 is a partial enlarged perspective view taken along line 4—4 of FIG. 2 without the panel members.

The golf tee 19, FIGS. 2 and 3, conventionally comprises an elongated tubular portion 20, and a disc-like base portion 21, adapted to be inserted upwardly through a hole formed in the mat. The tubular portion 20 will be of a length sufficient to extend beyond the brush surface of the mat, in order to elevate the golf ball supported thereon in a fashion similar to that of a conventional golf tee on a grass tee station.

In assembly, panel members 10 are conjoined by engaging the groove and finger elements on adjacent edges of registering panel members to form a mat assembly of desired dimension and configuration. The frame members are then assembled in permitter fashion around that mat by engagement of fingers formed on the inner periphery of the frame with registering grooves on the perimeter edge of the assembled mat.

Consequent on excessive wear or other degradation occurring to the bristles at any specific location on the mat, as for example adjacent to the tee, the panel member or members on which the brush wear has occurred can be lifted upwardly and out of the assembly for replacement, the remainder of the panel members remaining in place within the frame.

While it has been found that fingers and grooves formed in the edges of the molded panel members are most suitable, other engagement means for securing adjacent panel members will readily occur to those familiar with the art to which this invention relates, such as spring clips engaging in aperture formed in adjacent panels.

Further modifications and alternative embodiments of the invention will be apparent to those skilled in the art in view of the description.

Accordingly, the description is to be considered as illustrative only and is for the purpose of teaching those skilled in the art, the manner of carrying out the invention. It is understood that the form of the invention herewith shown and described is to be taken as the presently preferred embodiment, and that various changes may be made in the shape, size and general arrangement of the components.

What I claim is:

1. A golf driving mat, comprising:

a) an outer frame having a continuous outer perimeter;

b) a panel assembly disposed within said frame;

c) said panel assembly including a plurality of panels releasably joined with adjacent panels;

d) each said panel including a base having a plurality of engagement means on each of the edges thereof for interlocking engagement with adjacent panels;

e) said engagement means on said panels extending vertically in relation to said base for thereby permitting vertical separation of one panel from another;

f) said frame including a plurality of engagement means on the internal perimeter thereof for interlocking engagement with the engagement means of said panels; and g) bristles anchored within said base in an upstanding relationship thereto for thereby forming a simulated grass turf thereon.

2. The golf driving mat of claim 1, wherein:

a) said engagement means on said panels comprises fingers and grooves.

3. The golf driving mat of claim 1, wherein:

a) said engagement means are generally rectangular in shape.

4. The golf driving mat of claim 1, and including:

a) a golf tee.

* * * * *